US007598833B1

(12) United States Patent
Hodges et al.

(10) Patent No.: US 7,598,833 B1
(45) Date of Patent: Oct. 6, 2009

(54) ELECTRICAL SWITCHING APPARATUS, AND ARC CHUTE ASSEMBLY AND ARC HOOD ASSEMBLY THEREFOR

(75) Inventors: Thomas A. Hodges, Oakmont, PA (US); Paul R. Rakus, Chippewa Township, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 12/182,228

(22) Filed: Jul. 30, 2008

(51) Int. Cl.
*H01H 9/30* (2006.01)

(52) U.S. Cl. ..... 335/201; 218/149; 218/157

(58) Field of Classification Search ..... 335/201; 218/34–39, 81, 149–151, 155–158; 200/10
See application file for complete search history.

(56) References Cited

U.S. PATENT DOCUMENTS

| | | | | |
|---|---|---|---|---|
| 2,310,728 | A * | 2/1943 | Bartlett | 218/35 |
| 6,100,778 | A * | 8/2000 | Deylitz | 335/201 |
| 6,670,872 | B2 * | 12/2003 | Kurzmann | 335/201 |
| 6,977,354 | B1 * | 12/2005 | Shea et al. | 218/157 |
| 2008/0264906 | A1 * | 10/2008 | Kozar et al. | 218/157 |

* cited by examiner

*Primary Examiner*—Ramon M Barrera
(74) *Attorney, Agent, or Firm*—Martin J. Moran

(57) ABSTRACT

An arc chute assembly is for an electrical switching apparatus including a housing and an arc hood coupled thereto, the arc hood being structured to exhaust arc gases from the housing. The arc chute assembly includes a vent portion structured to exhaust arc gases from the housing into the arc hood and a frame portion adjacent the vent portion. The frame portion being structured to be movably coupled to the housing. The arc chute assembly being structured to be movable from a first position to a different second position relative to the housing responsive to the exhaust arc gases.

16 Claims, 4 Drawing Sheets

ELECTRICAL SWITCHING APPARATUS, AND ARC CHUTE ASSEMBLY AND ARC HOOD ASSEMBLY THEREFOR

BACKGROUND OF THE INVENTION

1. Field of the Invention

The invention relates generally to electrical switching apparatus and, more particularly, to arc chute assemblies and arc hood assemblies for electrical switching apparatus, such as circuit breakers.

2. Background Information

Electrical switching apparatus, such as circuit interrupters, provide protection for electrical systems from electrical fault conditions such as, for example, current overloads, short circuits, abnormal voltage and other fault conditions. Typically, circuit interrupters, such as circuit breakers, include a housing and an operating mechanism, which opens separable electrical contacts to interrupt the flow of current through the conductors of an electrical system in response to such fault conditions as detected, for example, by a trip unit.

Some low-voltage circuit breakers, for example, have arc chute vents on a portion (e.g., without limitation, the top) of the housing. When the separable electrical contacts rapidly open, for example, in response to an overload or short circuit condition, an arc is created which generates gases that are expelled from the vents. The gases can be extremely hot, are at least partly ionized, and may carry debris, such as molten metal particles. Furthermore, the gases and debris can be electrically conductive and, therefore, can cause additional undesirable arcing between the circuit breaker and grounded electrically conductive features proximate the circuit breaker, including but not limited to, the metallic enclosure in which such circuit breaker is typically installed. The gases may also be expelled with explosive force and may, therefore, damage components of the enclosure.

Accordingly, switchgear enclosures are typically designed to include one or more channels in which arc gases can be directed for dissipation thereof. Some switchgear cabinets also include an insulated barrier, commonly referred to as an arc hood, which is mounted above the arc chute vents of the circuit breaker through which the arc gases are exhausted. The arc hood functions to manage the effects of the arc gases and, in particular, to cool and dissipate the arc gases within the arc hood. However, there is room for improvement in the interface between the arc chute and arc hood.

SUMMARY OF THE INVENTION

These needs and others are met by embodiments of the invention, which are directed to an arc chute assembly for an electrical switching apparatus, an arc hood assembly for an electrical switching apparatus, and an electrical switching apparatus in which the arc chute assembly comprises a vent portion structured to exhaust arc gases from a housing into an arc hood and a frame portion adjacent the vent portion, with the frame portion structured to be movably coupled to the housing. The arc chute assembly is structured to be movable from a first position to a different second position relative to the housing responsive to the exhaust arc gases.

As one aspect of the invention, an arc chute assembly for an electrical switching apparatus is provided. The electrical switching apparatus includes housing and an arc hood coupled thereto. The arc hood being structured to exhaust arc gases from the housing. The arc chute assembly comprises: a vent portion structured to exhaust arc gases from the housing into the arc hood and a frame portion adjacent the vent portion, with the frame portion structured to be movably coupled to the housing. The arc chute assembly is structured to be movable from a first position to a different second position relative to the housing responsive to the exhaust arc gases.

The frame portion may be structured to abut the housing when at the first position and may be further structured to be generally spaced from the housing when at the different second position.

The arc hood may comprise a number of transverse members and the arc chute assembly may be structured to be spaced from the number of transverse members when at the first position. The arc chute assembly may be further structured to abut the number of transverse members when at the different second position.

The frame portion may comprise a number of fasteners structured to slidably couple the frame portion to the housing. The number of fasteners may comprise a shoulder bolt.

As another aspect of the invention, an arc hood assembly is for an electrical switching apparatus including a housing having a number of arc chutes with a vent portion structured to exhaust arc gases from the housing and a frame portion adjacent the vent portion. The number of arc chutes being movable from a first position to a different second position during venting of the arc gases. The arc hood assembly comprises: a hood member fixedly coupled to the housing at or near the number of arc chutes, the hood member being structured to receive and exhaust the arc gases vented from the housing, and a number of transverse members structured to contact the number of arc chutes when the number of arc chutes are in the different second position.

Each of the number of transverse members may comprise a substantially planar member. The vent portion may be generally planar and the substantially planar member may be oriented generally transverse to the vent portion. The number of transverse members may be structured to be spaced a predetermined distance from the number of arc chutes when the number of arc chutes are in the first position, and the number of transverse members may be structured to abut the number of arc chutes when the number of arc chutes are in the second position.

As a further aspect of the invention, an electrical switching apparatus comprises: a housing, separable contacts enclosed by the housing, and an operating mechanism structured to open and close the separable contacts. The separable contacts being structured to create an arc that generates arc gases when the separable contacts open. The electrical switching apparatus further comprises: a number of arc chute assemblies disposed with respect to the housing and an arc hood coupled to the housing at or near the vent portion of each of the number of arc chute assemblies. The arc hood being structured to receive the arc gases exhausted from the vent portion of each of the number of arc chute assemblies and exhausts the arc gases from the electrical switching apparatus. Each of the number of arc chute assemblies comprises: a frame portion movably coupled to the housing and a vent portion adjacent the frame portion, the vent portion being structured to exhaust the arc gases from the housing. Each of the number of arc chute assemblies being structured to be movable from a first position to a different second position relative to the housing responsive to the arc gases which exhaust from the housing.

The frame portion may abut the housing when at the first position and the frame portion may be spaced a distance from the housing when at the different second position.

The arc hood may comprise a number of transverse members. The number of arc chute assemblies may be spaced a predetermined distance from the number of transverse members when at the first position and the number of arc chute assemblies may abut the number of transverse members when at the different second position.

The frame portion may be movably coupled to the housing by a number of fasteners. Each of the number of fasteners may comprise a shoulder bolt.

Each of the number of transverse members may comprise a substantially planar member. The vent portion may be generally planar and the substantially planar member may be oriented generally transverse to the vent portion.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
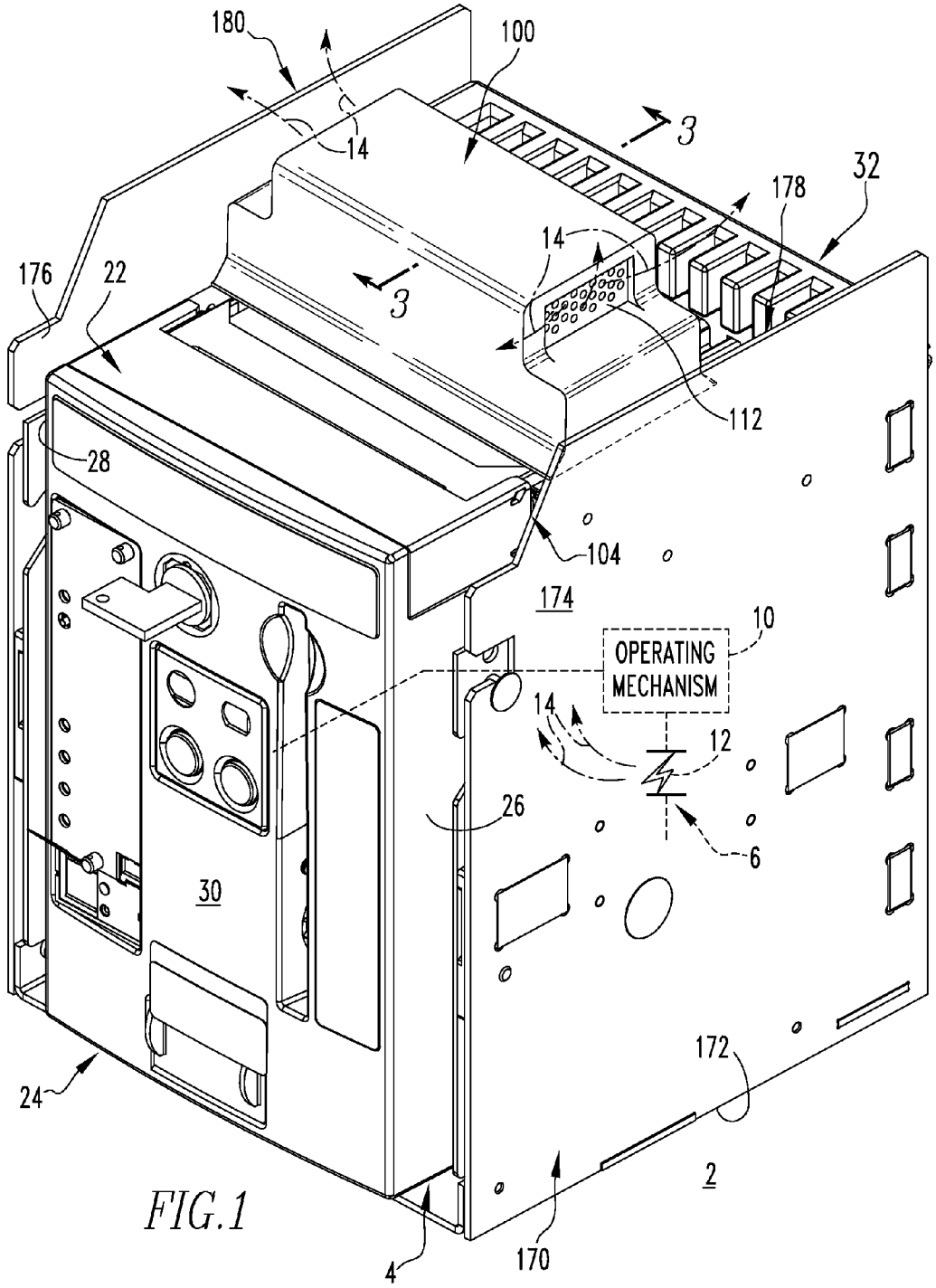
FIG. 1 is an isometric view of a circuit breaker and an arc hood assembly therefor, in accordance with an embodiment of the invention, showing the circuit breaker operating mechanism, a pair of separable contacts, and an arc in simplified form.

For purposes of illustration, embodiments of the invention will be described as applied to low-voltage circuit breakers, although it will become apparent that they could also be applied to a wide variety of electrical switching apparatus (e.g., without limitation, circuit switching devices and other circuit interrupters, such as contactors, motor starters, motor controllers and other load controllers) other than low-voltage circuit breakers and other than low-voltage electrical switching apparatus.

Directional phrases used herein, such as, for example, left, right, top, bottom, upper, lower, front, back and derivatives thereof, relate to the orientation of the elements shown in the drawings and are not limiting upon the claims unless expressly recited therein.

As employed herein, the term "fastener" shall mean a separate element or a number of elements which is/are employed to connect or tighten two or more components together, and expressly includes, without limitation, rivets, pins, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
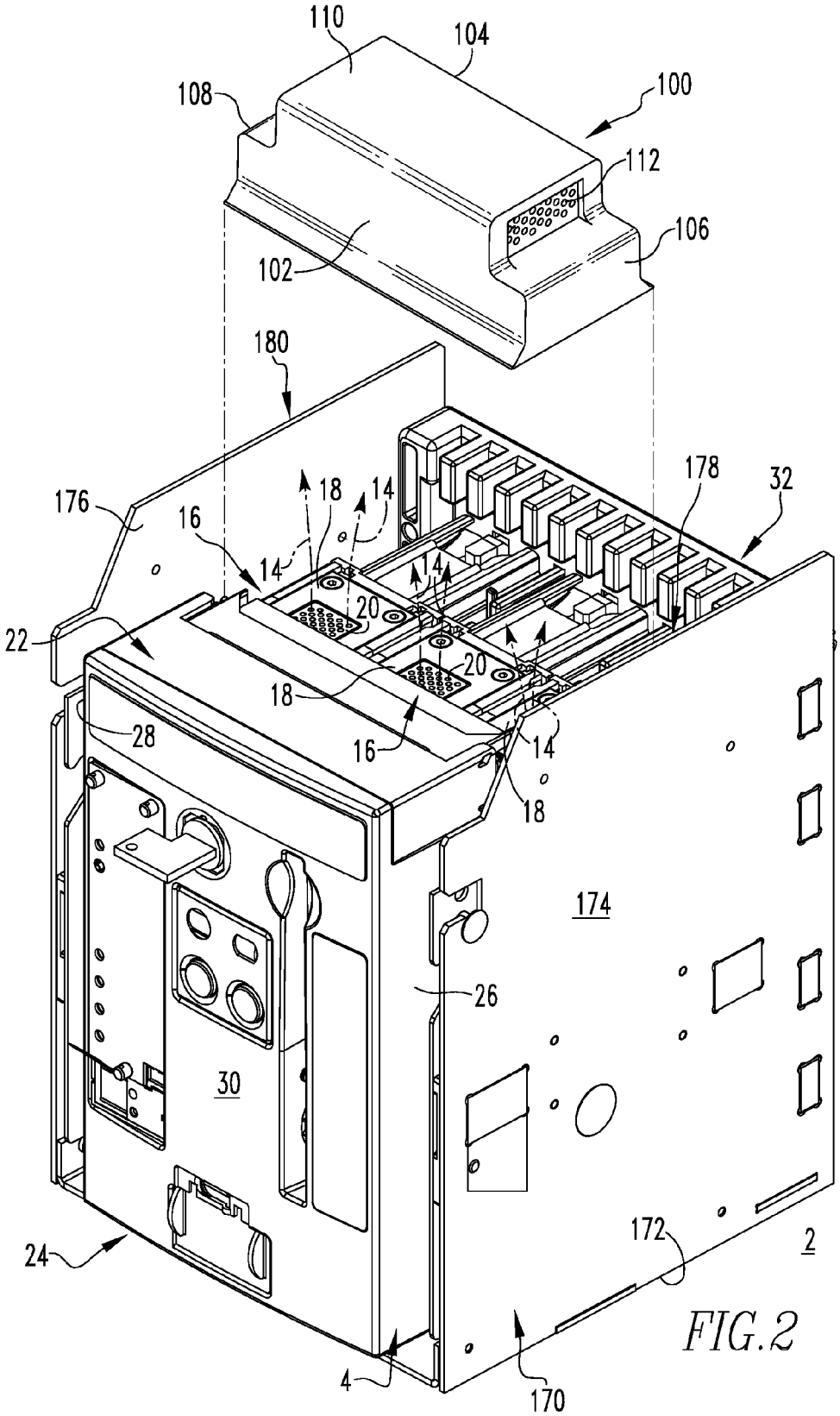
FIG. 2 is a partially exploded isometric view of the circuit breaker and arc hood assembly of FIG. 1.

FIGS. 1 and 2 show an electrical switching apparatus such as, for example, a low-voltage circuit breaker 2, and an arc hood assembly 100 therefor. The circuit breaker 2 includes a housing 4, separable contacts 6 (shown in simplified form in hidden line drawing in FIG. 1) enclosed by the housing 4, an operating mechanism 10 (shown in simplified form in hidden line drawing in FIG. 1), which is structured to open and close the separable contacts 6 (FIG. 1), and a number of arc chutes 16 (FIGS. 2-4).

The housing 4 of the example circuit breaker 2 includes a first end 22, a second end 24, a first side 26, a second side 28, a front 30, and a back 32. The circuit breaker 2 is disposable within a cassette 170, which in the example shown and described herein includes a bottom 172 and first and second sides 174,176 extending perpendicularly outwardly from the bottom 172. When the circuit breaker 2 is disposed within the cassette 170, as shown in FIGS. 1 and 2, the first side 26 of the circuit breaker housing 4 is disposed adjacent the first side 174 of the cassette 170, and the second side 28 of the circuit breaker housing 4 is disposed adjacent the second side 176 of the cassette 170. Thus, the second end 24 of the circuit breaker housing 4 is disposed adjacent the bottom 172 of the cassette 170, and the first end 22 of the circuit breaker housing 4 is disposed at or about the ends 178,180 of the first and second sides 174,176 of the cassette 170, as shown.

As shown in FIG. 2, each of the arc chutes 16 includes a frame portion 18 and a vent portion 20 with the frame portion 18 generally surrounding the vent portion 20. Each of the arc chutes 16 is generally oriented within the circuit breaker 2 such that the respective frame and vent portions 18,20 are generally disposed at or near the first end 22 of the housing 4. Each of the vent portions 20 is structured to exhaust arc gases 14 (shown in phantom line drawing in FIGS. 2 and 4) from the housing 4. As shown in FIG. 1, the arc gases 14 are generated from an arc 12 that is created when the separable contacts 6 open.

Figure 3:
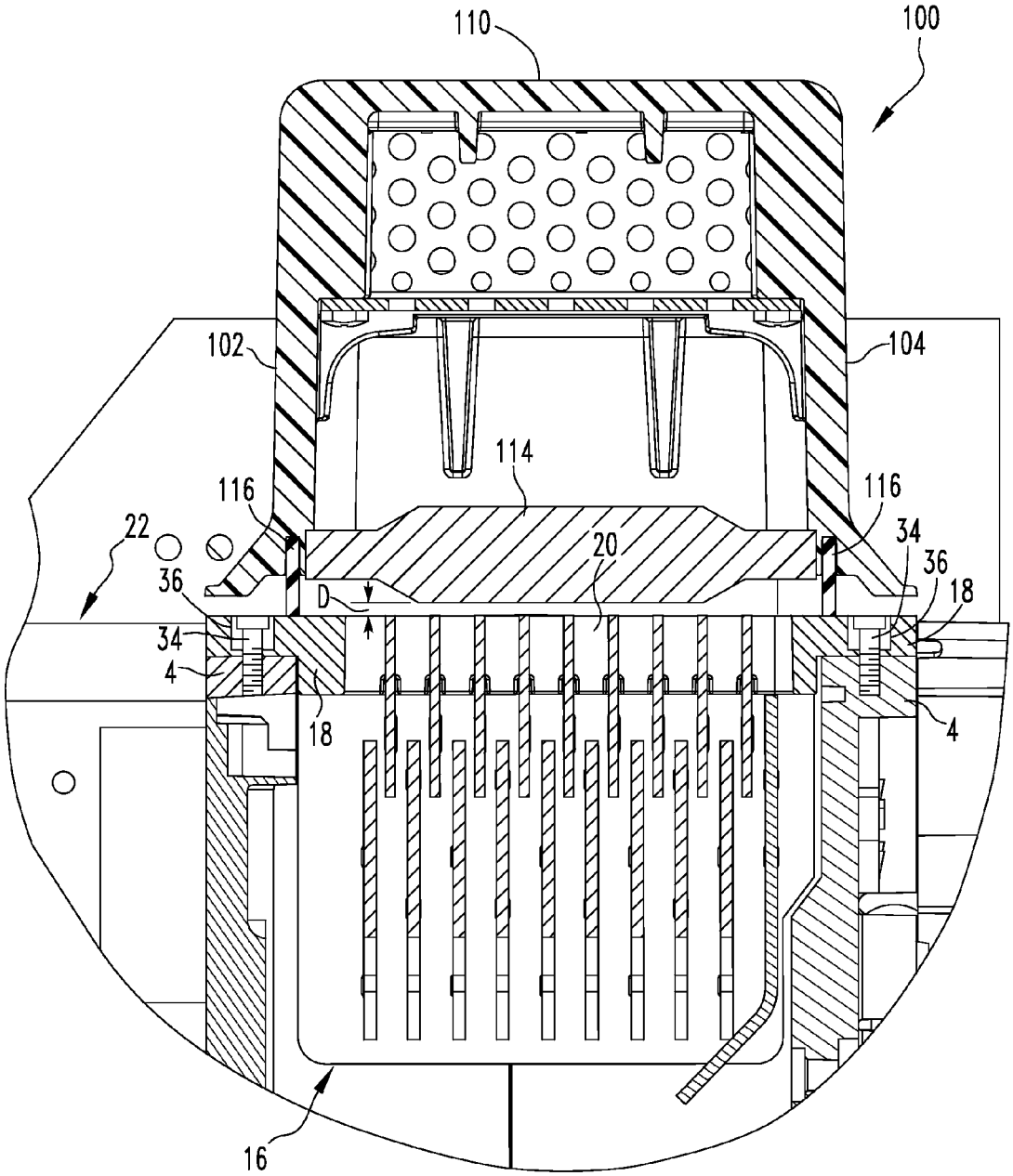
FIG. 3 is a cross-sectional view along lines 3-3 of FIG. 1 showing the arc chute assembly in a first position in accordance with an embodiment of the invention.
Figure 4:
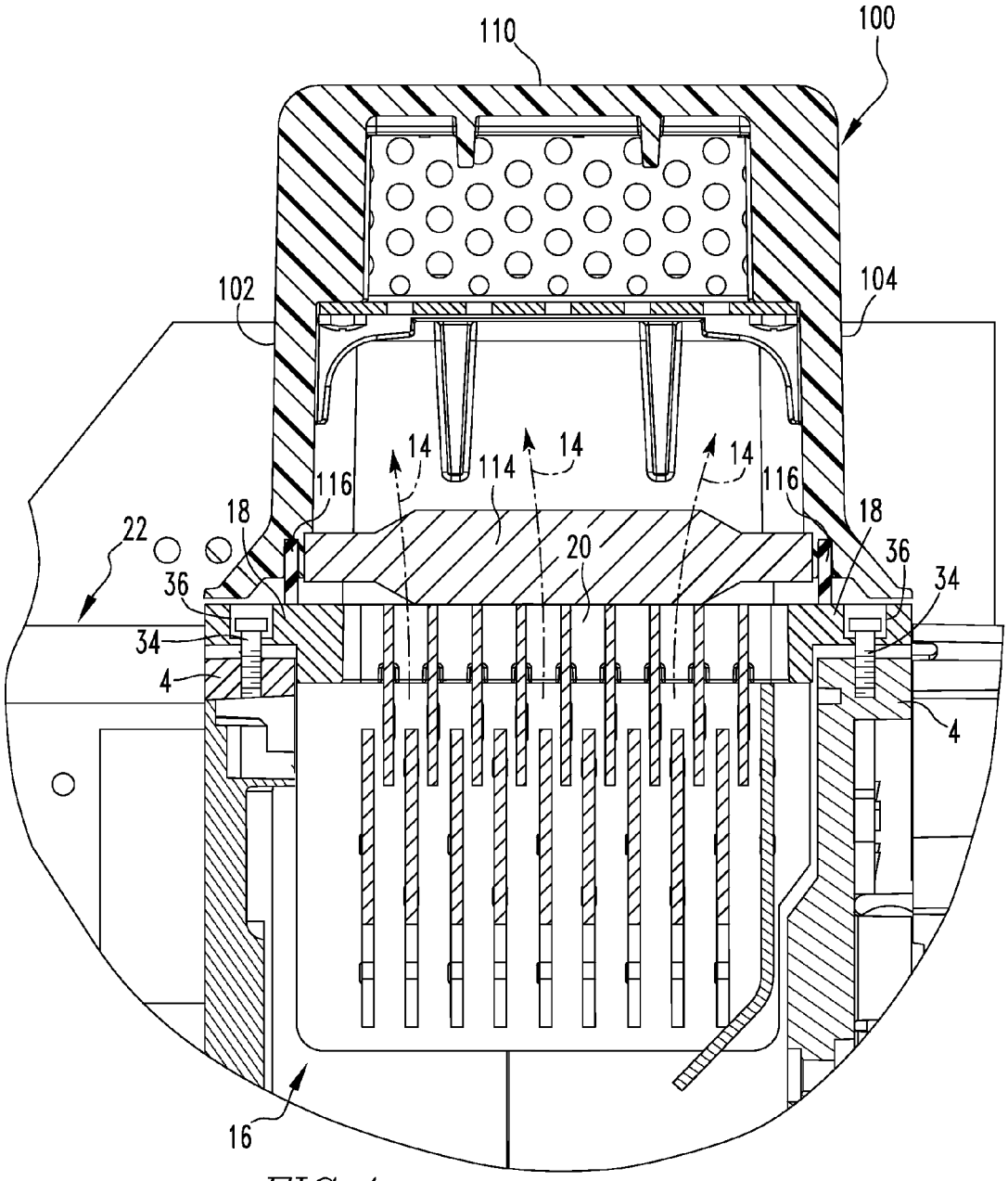
FIG. 4 is a cross-sectional view similar to FIG. 3 except showing the arc chute assembly in a different second position responsive to exiting arc gases.

As shown in FIGS. 3 and 4, each of the arc chutes 16 is movably coupled to the housing 4 via a number of shoulder bolts 34 that pass through stepped holes 36 in the frame portion 18 and are securely coupled to the housing 4. The shoulder bolts 34 allow for each of the arc chutes 16 to move from a first position (FIG. 3), in which the frame portion 18 generally abuts the housing 4, to a second position (FIG. 4) in which the frame portion 18 is generally spaced from the housing 4 upon passing of the exhaust arc gases 14 through the vent portion 20 of the respective arc chute 16. Such movement of the arc chutes 16 will be further discussed below.

The cassette 170 of FIGS. 1 and 2 further includes an arc hood assembly 100 generally spanning across the top of the cassette 170 from the end 178 of the first side 174 to the end 180 of the second side 176. The arc hood assembly 100 is generally positioned to cover the frame and vent portions 18,20 of each of the arc chutes 16 when the circuit breaker 2 is fully installed within the cassette 170 and is preferably formed from MAR-BAL MB2000-20, RED-Eaton Specification #80220AA, however other suitable materials may be employed without departing from the scope of the invention.

Referring to FIG. 2, the arc hood assembly 100 generally includes a first side 102, a second side 104, a first end 106, a second end 108, and a top 110. As shown in FIG. 4, the arc hood assembly 100 is structured to receive the exhausted arc gases 14 (previously discussed) from the vent portions 20 of each of the arc chutes 16. In order to further provide for the venting of the arc gases 14 from the circuit breaker 2 and cassette 170, the arc hood assembly 100 includes a number of apertures 112 through which the exhausted arc gases 14 may further pass, as shown in FIG. 1. The example arc hood assembly 100 shown includes two apertures 112, however it is to be appreciated that any suitable number/and or configuration of apertures 112 could be employed without departing from the scope of the invention.

As shown in FIGS. 3 and 4, the arc hood assembly 100 further includes a number of cross-members 114 that generally extend between the first and second sides 102,104 of the arc hood assembly 100. Preferably, each of cross-members 114 is of generally planar shape and formed from a standard cold or hot rolled steel Eaton specification #10102HT or #10101AC respectively cut from conventional sheet or roll steel at specified thickness. However, it is to be appreciated that other suitable materials may be employed without departing from the scope of the invention. As shown in FIG. 3, each of the cross-members 114 is preferably oriented generally transverse to vent portion 20 and generally spaced a distance D from the vent portion 20 when the arc chute 16 is in the first position. As shown in FIG. 4, when the arc chute 16 is moved to a second position due to the passing of exhaust arc gases 14 through the vent portion 20, the vent portion 20 abuts cross-member 114 such that cross-member 114 effectively limits the upward travel (with respect to FIGS. 3 and 4) of the arc chute 16.

In order to prevent uncontrolled escape of the exhaust arc gases 14, a flexible gasket 116 is provided that generally seals between the respective frame portions 18 of each of the arc chutes 16 and the arc hood assembly 100. Preferably, gasket 116 is made of VITON RUBBER DUROMETER 55-65 SHORE A, BLACK Eaton Specification #45551HB1PE, however other suitable materials may be employed without departing from the scope of the invention. The preferred flexibility of the gasket 116 allows for a seal to be maintained between each of the frame portions 18 and the arc hood assembly 100 when the arc chute 16 is disposed in the first position (FIG. 3), the second position (FIG. 4), or at any position there between.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An arc chute assembly for an electrical switching apparatus including housing and an arc hood coupled thereto, said arc hood being structured to exhaust arc gases from said housing, said arc chute assembly comprising:

a vent portion structured to exhaust arc gases from said housing into said arc hood; and a frame portion adjacent said vent portion, said frame portion structured to be movably coupled to said housing, wherein said arc chute assembly is structured to be movable from a first position to a different second position relative to said housing responsive to said exhaust arc gases.

2. The arc chute assembly of claim 1 wherein said frame portion is structured to abut said housing when at said first position; and wherein said frame portion is structured to be generally spaced from said housing when at said different second position.

3. The arc chute assembly of claim 1 wherein said arc hood comprises a number of transverse members; wherein said arc chute assembly is structured to be spaced from said number of transverse members when at said first position; and wherein said arc chute assembly is further structured to abut said number of transverse members when at said different second position.

4. The arc chute assembly of claim 1 wherein said frame portion comprises a number of fasteners structured to slideably couple said frame portion to said housing.

5. The arc chute assembly of claim 4 wherein each of said number of fasteners comprises a shoulder bolt.

6. An arc hood assembly for an electrical switching apparatus, said electrical switching apparatus including a housing having a number of arc chutes having a vent portion structured to exhaust arc gases from said housing and a frame portion adjacent said vent portion, said number of arc chutes being movable from a first position to a different second position during venting of said arc gases, said arc hood assembly comprising:

a hood member fixedly coupled to said housing at or near said number of arc chutes, said hood member being structured to receive and exhaust said arc gases vented from said housing; and a number of transverse members structured to contact said number of arc chutes when said number of arc chutes are in said different second position.

7. The arc hood assembly of claim 6 wherein each of said number of transverse members comprises a substantially planar member.

8. The arc hood assembly of claim 7 wherein said vent portion is generally planar and said substantially planar member is oriented generally transverse to said vent portion.

9. The arc hood assembly of claim 6 wherein said number of transverse members are structured to be spaced a predetermined distance from said number of arc chutes when said number of arc chutes are in said first position; and wherein said number of transverse members are structured to abut said number of arc chutes when said number of arc chutes are in said second position.

10. An electrical switching apparatus comprising:

a housing;

separable contacts enclosed by said housing;

an operating mechanism structured to open and close said separable contacts, which are structured to create an arc that generates arc gases when said separable contacts open;

a number of arc chute assemblies disposed with respect to said housing, each of said number of arc chute assemblies comprising:

a frame portion movably coupled to said housing; and a vent portion adjacent said frame portion, said vent portion being structured to exhaust the arc gases from said housing; and an arc hood coupled to said housing at or near the vent portion of each of said number of arc chute assemblies, said arc hood being structured to receive the arc gases exhausted from said vent portion of each of said number of arc chute assemblies and exhaust said arc gases from said electrical switching apparatus, wherein each of said number of arc chute assemblies is structured to be movable from a first position to a different second position relative to said housing responsive to said arc gases which exhaust from said housing.

11. The electrical switching apparatus of claim 10 wherein said frame portion abuts said housing when at said first position; and wherein said frame portion is spaced a distance from said housing when at said different second position.

12. The electrical switching apparatus of claim 10 wherein the frame portion is movably coupled to said housing by a number of fasteners.

13. The electrical switching apparatus of claim 12 wherein each of said number of fasteners comprises a shoulder bolt.

14. The electrical switching apparatus of claim 10 wherein said arc hood comprises a number of transverse members; wherein said number of arc chute assemblies are spaced a predetermined distance from said number of transverse members when at said first position; and wherein said number of arc chute assemblies abut said number of transverse members when at said different second position.

15. The electrical switching apparatus of claim 14 wherein each of said number of transverse members comprises a substantially planar member.

16. The electrical switching apparatus of claim 15 wherein the vent portion is generally planar and said substantially planar member is oriented generally transverse to said vent portion.

* * * * *